US005988407A

United States Patent [19]

Battaglia

[11] Patent Number: 5,988,407

[45] Date of Patent: Nov. 23, 1999

[54] MERCHANDISING SHELF ASSEMBLY

[75] Inventor: Joseph M. Battaglia, Douglasville, Ga.

[73] Assignee: L&P Property Management Company, South Gate, Calif.

[21] Appl. No.: 09/046,326

[22] Filed: Mar. 23, 1998

Related U.S. Application Data

[63] Continuation-in-part of application No. 08/919,891, Aug. 28, 1997.

[51] Int. Cl.[6] ..... B42F 7/00

[52] U.S. Cl. ..... 211/51

[58] Field of Search ..... 211/51, 59.3, 184

[56] References Cited

U.S. PATENT DOCUMENTS

| | | |
|---|---|---|
| D. 277,915 | 3/1985 | Field . |
| 1,229,948 | 6/1917 | Hall . |
| 1,682,580 | 8/1928 | Pratt . |
| 1,728,694 | 9/1929 | Morris . |
| 1,893,098 | 1/1933 | Murray, Sr. et al. . |
| 1,959,614 | 5/1934 | Coons . |
| 2,095,649 | 10/1937 | Oswell . |
| 2,124,780 | 6/1938 | Keppler et al. . |
| 2,222,887 | 11/1940 | Willey . |
| 2,331,035 | 10/1943 | Lundstrom . |
| 2,435,104 | 1/1948 | Solomon . |
| 2,538,165 | 1/1951 | Randtke . |
| 2,564,518 | 8/1951 | Bedinger . |
| 2,656,233 | 10/1953 | Bollmann . |
| 2,732,952 | 1/1956 | Skelton . |
| 2,855,632 | 10/1958 | Croce et al. . |
| 2,927,699 | 3/1960 | McGraw . |
| 2,954,129 | 9/1960 | Gordon . |
| 3,039,221 | 6/1962 | Musgrave . |
| 3,110,402 | 11/1963 | Mogulescu . |
| 3,357,597 | 12/1967 | Groff . |
| 3,393,948 | 7/1968 | Brefka . |
| 3,583,724 | 6/1971 | Cowlin . |
| 3,612,288 | 10/1971 | Lesley . |
| 3,679,096 | 7/1972 | Musser . |
| 4,234,101 | 11/1980 | Pastore . |
| 4,314,648 | 2/1982 | Spamer . |
| 4,588,093 | 5/1986 | Field . |
| 4,822,555 | 4/1989 | Kawabata . |
| 4,838,436 | 6/1989 | Bailey . |
| 4,919,403 | 4/1990 | Bartholomew . |
| 5,240,125 | 8/1993 | Kunz . |
| 5,419,443 | 5/1995 | Niederberger et al. . |
| 5,449,076 | 9/1995 | Van Noord . |
| 5,450,968 | 9/1995 | Bustos . |
| 5,450,969 | 9/1995 | Johnson et al. . |
| 5,577,623 | 11/1996 | Bustos . |
| 5,614,288 | 3/1997 | Bustos . |
| 5,641,077 | 6/1997 | Tufano et al. . |
| 5,665,304 | 9/1997 | Heinen et al. . |

*Primary Examiner*—Alvin Chin-Shue
*Assistant Examiner*—Sarah Purol
*Attorney, Agent, or Firm*—Wood, Herron & Evans, L.L.P.

[57] ABSTRACT

A shelf assembly comprising a shelf having a bottom member, a plurality of substantially parallel spaced dividers extending from back to front and a serpentine shaped pusher for urging a column of products forwardly inside a track defined by the bottom member and a pair of dividers. The pusher comprises a sheet of inherently resilient flexible material having a sinusoidal configuration. The pusher extends between a stop and a rearwardmost product within a column of products in a track.

43 Claims, 6 Drawing Sheets

MERCHANDISING SHELF ASSEMBLY

RELATED APPLICATION INFORMATION

This patent application is a continuation-in-part application of U.S. patent application Ser. No. 08/919,891 filed Aug. 28, 1997 which is hereby fully incorporated by reference.

FIELD OF THE INVENTION

This invention relates to a self-feeding shelf assembly and, more particularly, to a shelf assembly in which a serpentine shaped pusher pushes a column of product arranged on a shelf of the assembly forwardly to locate a forwardmost object in the column at the front of the shelf.

BACKGROUND OF THE INVENTION

Merchants commonly display their products in shelved structures. Often such shelved structures have a plurality of shelves, each shelf having a plurality of dividers dividing the shelf into a plurality of tracks extending from the back of the shelf forwardly. Product being displayed is arranged in columns on the shelf, the columns of product being located within the tracks. These tracks enable the merchant to separate items for purposes of maximizing the number of objects or items being displayed or to enable different items in different tracks to be displayed. Typically, a consumer removes the forwardmost product in a column. If the shelf is horizontally oriented, the products behind the forwardmost product in a track may remain in essentially the same position once the forwardmost product has been removed such that a second consumer must reach further back in the display to grasp the closest available product within the track. As more products are removed from the track, customers must reach further back inside the track to grasp a product.

In order to provide a continuous supply of product at the front of the tracks of shelves of a display rack, shelves have been declined such that the front of the shelves are located below the rear of the shelves. Gravity then forces the product to the forward edge of such shelves where it is easily accessible to customers. The angle of the shelf determines the amount of force gravity will have on the product so that the product moves forward. Often plastic slip surfaces, such as that disclosed in U.S. Pat. No. 5,614,288, are placed on such shelves providing a slip surface enabling the products to more easily slide forwardly to the front of the declined shelf. The plastic used to make such slip surfaces may be impregnated with silicone in order to increase the slipperiness of the plastic so that products may more easily slide down the slip surface to the front of the shelf. Even without a declined shelf, a plastic slip surface may aid in the delivery of products to the front of the shelf.

Several patents have disclosed devices which have attempted to move product forwardly on a horizontal shelf. U.S. Pat. No. 2,732,952 discloses a shelf attachment which comprises two plates hinged together at the top of the plates. A spring urges the two plates apart from one another such that when the shelf attachment is placed between a vertical wall and product on a horizontal shelf, the spring causes the plates to separate urging the product forwardly on the shelf. The rear plate is attached to the vertical wall with screws and the forwardmost plate has a strip upon which the rearwardmost products on the shelf rest. Although this patent does disclose a device for urging products forwardly on a horizontal shelf, the springs used in the device are subject to wear and tear and may deteriorate over time causing the device to not function properly. Further, such a device must be secured to a vertical wall at the back of the shelf with screws and without such a vertical wall, the device will not function correctly.

Similarly, U.S. Pat. No. 5,450,969 discloses a device for use on a horizontal shelf for urging products forwardly on the shelf. The shelf is divided into tracks by dividers and a backing plate urges a row of products forwardly within each track. Each backing plate is urged forwardly by a coiled spring located behind the backing plate, the coiled spring being secured at the front of the track. The spring is coiled behind the backing plate such that when the forwardmost product within a track is removed, the backing plate pushes the row of products forwardly in the track by the force of the spring pushing on the rear of the backing plate. Again, this device utilizes a spring which is subject to wear over time. In addition, the backing plate rides within a groove in the shelf bottom and may become stuck in the groove causing the backing plate to not move forwardly.

Another patent which discloses a merchandise display device in which there is a pusher positioned at the rear of a display case or drawer for pushing product forwardly in the display case or drawer is U.S. Pat. No. 4,588,093. In this patent, the pusher is in the form of an accordion-like expansible member which includes plural steel spring biasing clips positioned at each of the apexes of the accordion. With time and repeated use, the spring biasing clips may become worn and fail to function properly. In addition, the inclusion of the spring biasing clips into this pusher increases the cost of manufacturing the pusher and the cost of material to do so.

Therefore, it has been one objective of the present invention to provide an inexpensive pushing mechanism for urging a column of products forwardly inside a track on a shelf which is not subject to wear over time and does not deteriorate with repeated use.

It further has been an objective of the present invention to provide a mechanism for urging columns of products forwardly in tracks on a shelf which does not need to be secured to a vertical wall behind the shelves.

Further, it has been an objective of the present invention to provide a pusher mechanism for urging products forwardly on a shelf which may be quickly and inexpensively added to a back of a shelf and which may be easily moved from track to track on a shelf.

SUMMARY OF THE INVENTION

The invention of this application which accomplishes these objectives comprises a shelf assembly comprising a shelf having multiple dividers and a serpentine-shaped pusher between each pair of dividers for urging a column of products forwardly on the shelf.

The shelf comprises a bottom member and a plurality of substantially parallel spaced dividers extending from the back of the shelf to the front of the shelf. The bottom member of the shelf may be secured to a shelf support in any known manner in order to hold the shelf at a specific vertical location. The bottom member of the shelf may be horizontally oriented or declined such that the front edge of the shelf is located in a lower horizontal plane than the rear edge of the shelf. A pair of dividers and the bottom member define a track for supporting a plurality of products arranged in a column between the pair of dividers. The dividers may be integrally formed with the bottom member or separate from the bottom member and adjustable thereon.

As an alternative to having the track defining dividers mounted directly upon or formed as a portion of the shelf, the track defining dividers may be formed as wall portions of product supporting holders located on a shelf. In that event, a plurality of substantially parallel product holders are supported on the shelf. Each product holder comprises a bottom and a pair of sidewall dividers extending upwardly from the bottom so that the product holder is channel or generally U-shaped. The product holder may further have a bumper, label holder or other structure at the front of the product holder in order to prevent products held within the product holder from falling off the forward edge of the product holder. The product holder supports a plurality of products arranged in a column between the sidewall dividers of the product holder. The bottom and pair of sidewall dividers of the product holder define a track adapted to receive and hold product arranged in a linear column.

Irrespective of how the track is formed, a serpentine-shaped pusher is located in the track for urging a column of products forwardly along the track toward the front of the shelf. The pusher comprises a sheet of inherently resilient flexible plastic material having a sinusoidal configuration such that the plastic memory of the resilient pusher urges the pusher to return to its original sinusoidal shape after being compressed. The pusher extends between a stop located toward the rear of the shelf and a rearwardmost product in the column of products in the track so as to urge the column of products forwardly. The serpentine-shaped pusher is compressed when the track is full of product so that the amplitude of the sinusoidal configuration of the serpentine-shaped pusher is greater when the pusher is compressed then when the pusher is at rest or uncompressed. The pusher is at rest when there are no products in the track enabling the pusher to extend approximately the entire length of the track.

A plurality of guide rails may be secured to the dividers, a guide rail being located on each divider on the inside surface of a track so that each track has two guide rails which function to guide the serpentine-shaped pusher. The guide rails are spaced above the bottom member of the shelf and are all located at approximately the same height. The guide rails have upwardly or inwardly turned ends at the front and back of the guide rails in order to prevent the pusher from disengaging from the guide rails and falling off either the front or back of the shelf. The guide rails extend from approximately the rear edge of the divider to a location just behind the front edge of the divider so that when the pusher is fully extended and engaged with the front ends of the guide rails, there is room in the track for one product in front of the pusher.

The pusher has a front edge, a rear edge, and two opposed side edges. A plurality of generally rectangular shaped recesses may be cut in the side edges and extend inwardly toward the middle of the pusher. The recesses are adapted to engage the guide rails and prevent the pusher from disengaging from the guide rails. As product is removed from the track, the pusher moves forwardly increasing in length and decreasing in amplitude forcing the forwardmost product in the track to the front of the shelf.

The pusher may alternatively have a plurality of tabs extending downwardly from the lowermost points of the pusher. These tabs are adapted to slidably engage a slot formed in the bottom member of the shelf or, alternatively, in the bottom of the product holders. The slot extends from the rear of the shelf or product holder forwardly to approximately the distance of one product behind the front edge of the shelf or product holder. Thus, the pusher may extend forwardly, the tabs slidably moving in the slot as product is removed.

The pusher of the present invention need not be permanently secured to the shelf assembly and may simply be removed by slightly rotating the pusher causing the recesses of the pusher to separate from the guide rails secured to the dividers or the tabs of the pusher to disengage from the slot formed in the bottom member of the shelf or the bottom of a product holder. Thus, the pushers may be easily exchanged and relocated from track to track.

These and other objects and advantages of the invention of this application will become more readily apparent from the following description of the drawings.

DETAILED DESCRIPTION OF THE DRAWINGS

Figure 1:
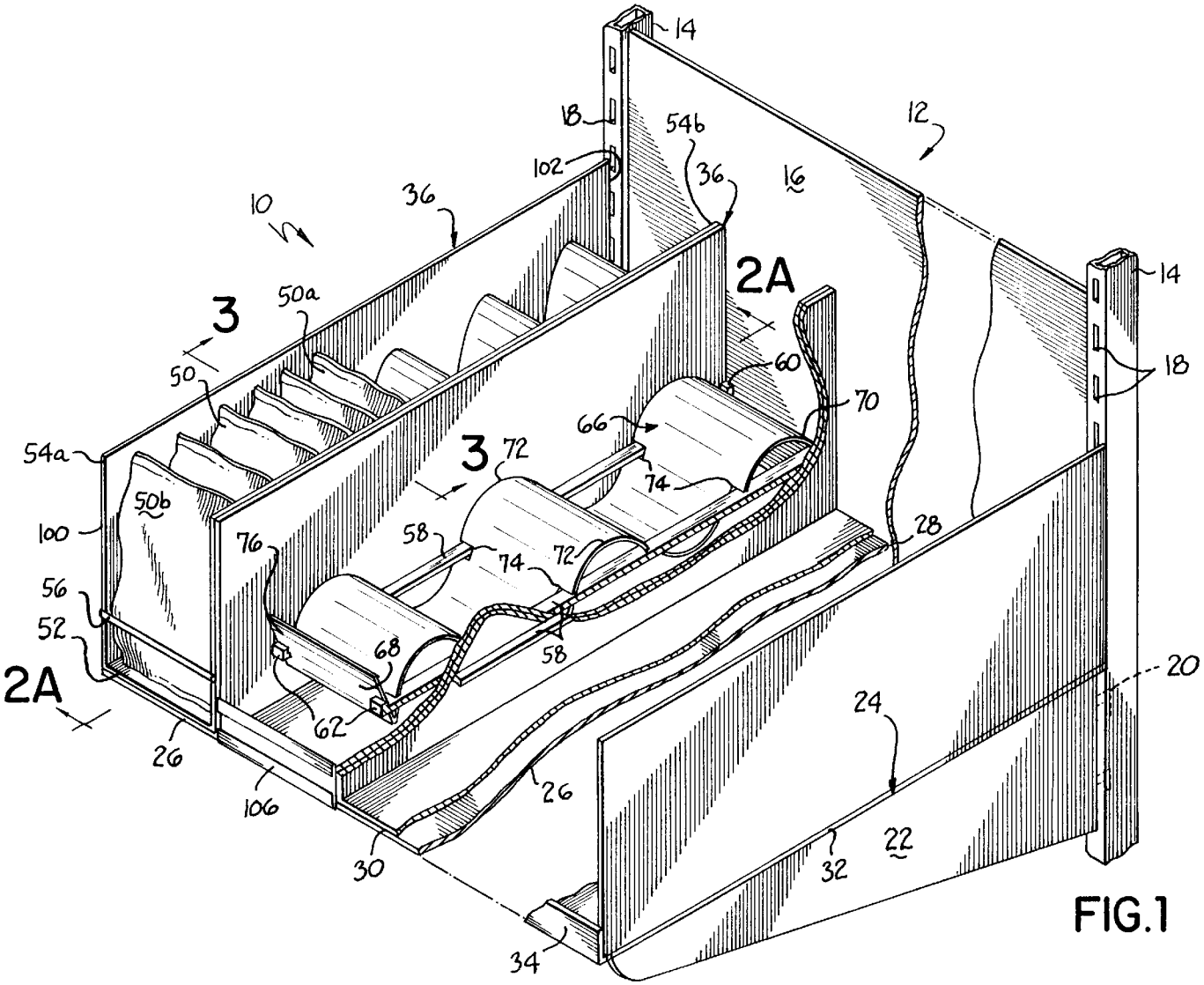
FIG. 1 is a perspective view of the shelf assembly of the present invention.
Figure 5:
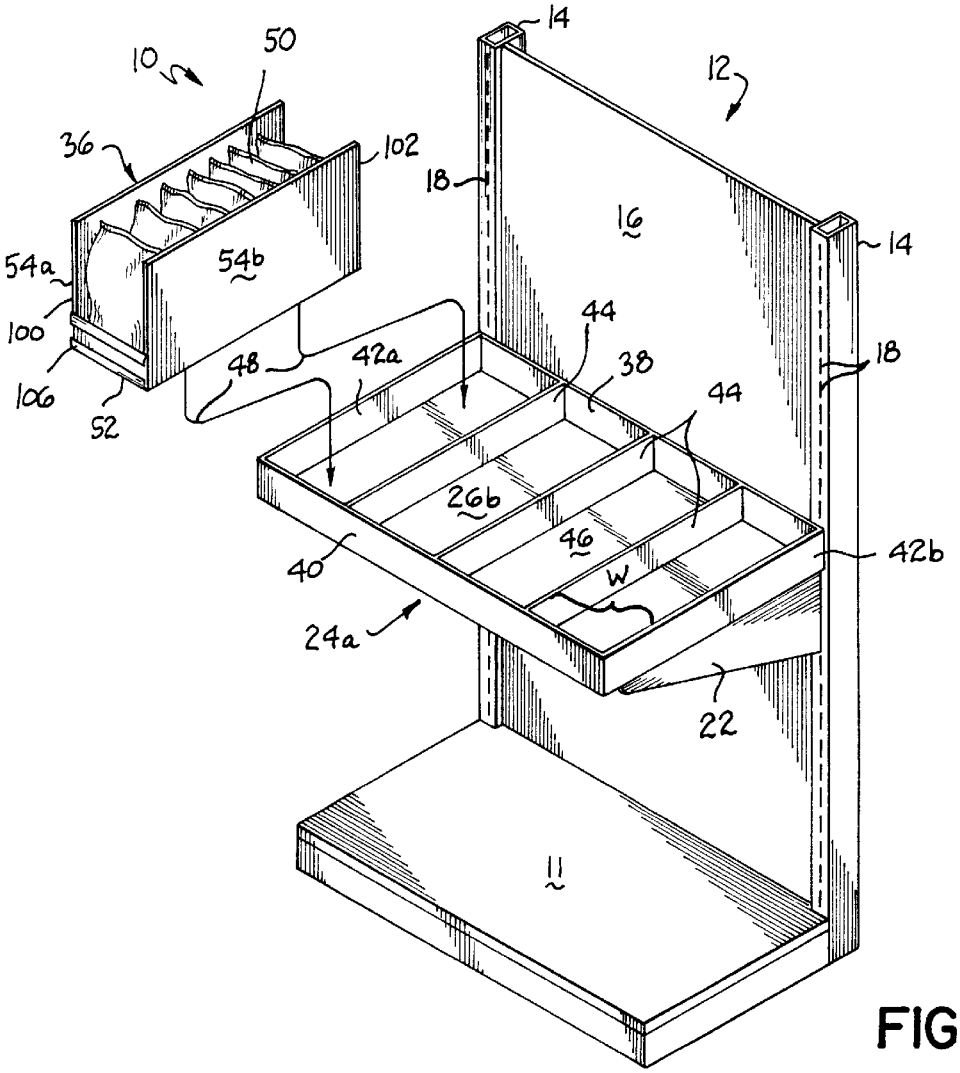
FIG. 5 is a perspective view of a product holder of the present invention being placed on a shelf specifically manufactured to receive and hold product holders.

Referring to the drawings and particularly to FIG. 1, there is illustrated a shelf assembly 10 including a shelf support 12. A shelf support 12 may take on any number of forms such as gondola racks or four poster racks. For purposes of illustration only, the shelf support 12 is illustrated in FIGS. 1 and 5 as a gondola style rack having a base 11 and two vertical posts 14 extending upwardly from the base 11. A back member 16 extends between the vertical posts 14.

As illustrated in FIG. 1, the posts 14 may have a plurality of slots 18 therein adapted to receive a plurality of tabs 20 extending rearwardly from the back of shelf supporting members 22. The shelf supporting members 22 arebing cantilevered from the posts 14 and may be vertically adjustable in order to provide the desired vertical spacing between shelves.

A shelf 24 rests on the supporting members 22. The shelf 24 comprises a substantially planar bottom member 26 having a rear edge 28, a front edge 30 and two opposed side edges 32. The distance between the side edges 32 defines the longitudinal dimension of the shelf and the distance from the back edge 28 to the front edge 30 of the shelf 24 defines the transverse dimension of the shelf. The bottom member 26 of the shelf 24 may have an upwardly turned lip 34 as illustrated in FIG. 1 in order to hold a plurality of U-shaped product holders 36 on the shelf. The shelf illustrated in FIG. 1 is illustrated as being a solid member. However, the bottom member 26 of the shelf 24 may comprise a wire grid or sheet metal frame such as is conventional for product shelving in retail stores.

An alternative embodiment of the shelf of the present invention is illustrated in FIG. 5. This shelf 24*a* comprises a substantially planar bottom member 26*b*, a rear wall 38, a front wall 40 and two outermost sidewalls 42*a, b*. In addition, a plurality of separators 44 extend between the front and back walls 40, 38 dividing the shelf into a plurality of receptacles 46, each receptacle 46 having a width W, the width W being the longitudinal distance between adjacent separators 44. The width W between adjacent separators 44 may be any distance desired in order to receive product holders 36. As illustrated by the arrows 48 in FIG. 5, the product holders 36 are adapted to be lifted away from the shelf 24*a*, filed with product 50 and then placed back into receptacles 46.

Figure 5A:
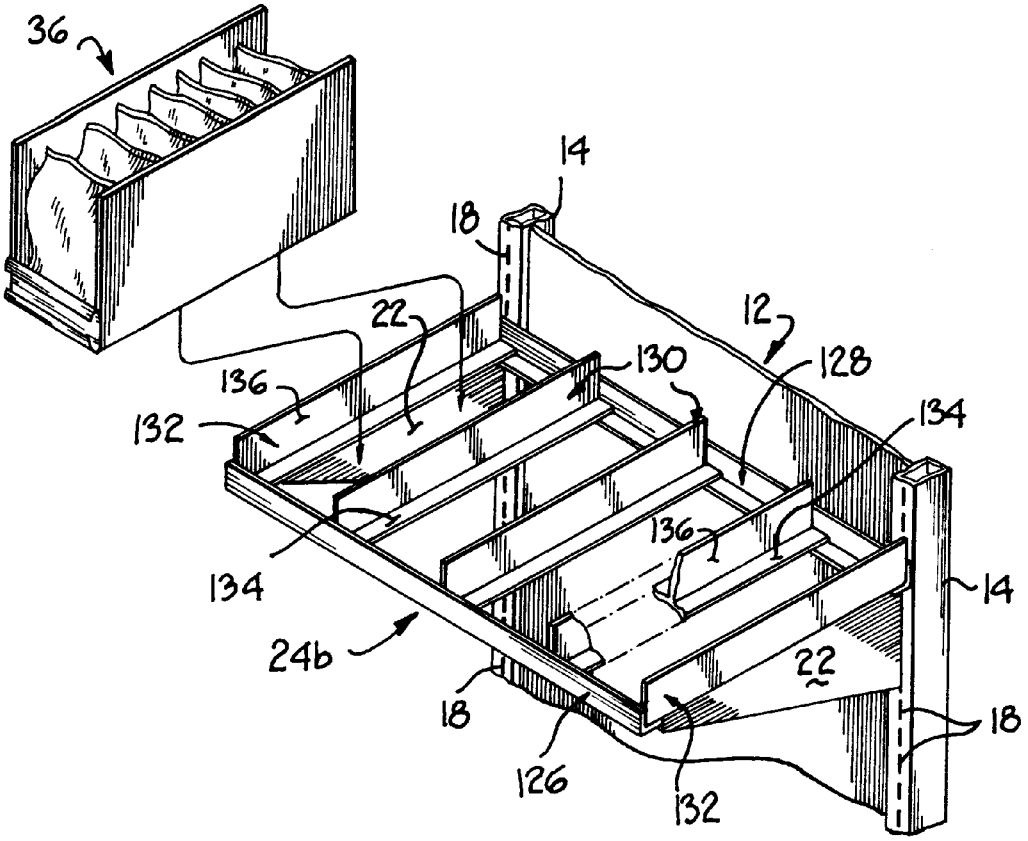
FIG. 5A is a perspective view of a product holder being placed on an alternative embodiment of the shelf.

Yet another embodiment of the shelf of the present invention is illustrated in FIG. 5A. This shelf 24*b* comprises a front frame member 126 spaced forwardly of a rear frame member 128. The rear frame member 128 may be secured to the shelf support 12 in any known manner, including but not limited to projections (not shown), extending from the rear frame member 128 into the holes or slots 18 of the vertical posts 14 of the shelf support 12. The shelf 24*b* may or may not be supported by shelf supporting members 22.

A plurality of substantially parallel internal dividers 130 and two endmost dividers 132 extend between the front frame member 126 and the rear frame member 128. Each divider has a horizontal portion 134 and a vertical portion 136. Internal dividers 130 are in the shape of an inverted T, the vertical portion 136 extending upwardly from the middle of the horizontal portion 134. The endmost dividers 132 have an L-shaped cross section. The internal dividers 130 may be laterally moved so as to support a product holder 36 between a pair of dividers. The product holder 36 rests on the horizontal portions 134 of the dividers and may be removed in order to fill the product holder 36 with additional product.

Referring back to FIG. 1, a plurality of substantially parallel generally U-shaped product holders 36 rest on the upper surface of the shelf 24. The lip 34 of the shelf prevents the product holders 36 from falling off the forward edge of the shelf. Although not illustrated in FIG. 1, the shelf may have upwardly extending side lips to prevent the product holders 36 from falling off the sides of the shelf.

As illustrated in FIGS. 1 and 5, each product holder 36 comprises a bottom 52 and a pair of sidewall dividers 54*a*, 54*b* which extend upwardly from the bottom 52 forming a generally U-shaped or channel shaped product holder 36. The product holder 36 has a front edge 100 and a rear edge 102. The distance between the front edge 100 and the rear edge 102 defines the longitudinal dimension of the product holder 36. The two sidewall dividers 54*a*, 54*b* and the bottom of the product holder 36 form a track extending from back to front of the shelf adapted to receive a plurality of products 50.

As shown in FIG. 1, the product holder 36 may have a bumper 56 extending from sidewall divider 54*a* to the other sidewall divider 54*b* at the front of the product holder 36 in order to prevent products 50 inside the product holder 36 from falling forwardly off the product holder and shelf. Similarly, instead of a bumper, the product holder 36 may have a label holder or price channel 106 or other structure which acts as a bumper and is adapted to receive a label identifying the product 50 placed in the product holder 36. The product holder 36 otherwise has an open top and an open front and back. The distance between the sidewall dividers 54*a* and 54*b* of a product holder 36 defines the width of the product holder and is generally a distance sufficient to hold a plurality of products 50. Although chip bags are illustrated, any other products may be used in accordance with the present invention.

The sidewall dividers 54*a*, 54*b* of the product holders 36 may be equipped with guide rails 58. The guide rails 58 may be integrally formed in the sidewall dividers 54*a*, 54*b* of the product holders 36 or may be separate members secured by any means to the inside surface of the sidewall dividers 54*a*, 54*b*. Each product holder 36 may have two guide rails 58 at approximately the same elevation or distance from the bottom 52 of the product holder 36. Each guide rail 58 extends from the rear end or edge 102 of the product holder 36 forwardly to a distance approximately the width of one product (chip bag) away from the front edge 100 of the product holder 36. Each guide rail 58 has an upwardly turned back end 60 and an upwardly turned front end 62. Although upwardly turned ends 60, 62 of the guide rails 58 are illustrated, the ends 60, 62 of the guide rails 58 could alternatively be downwardly or inwardly turned or have other configurations such as a bulb thereon so that the ends of the guide rails are larger in cross section than the remainder of the guide rails.

Figure 2A:
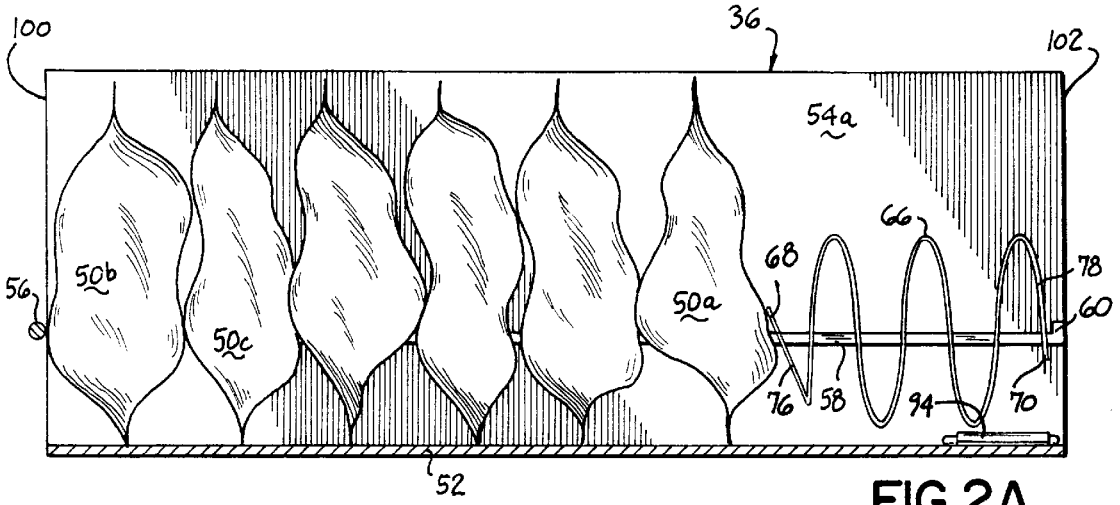
FIG. 2A is a cross-sectional view taken along the lines 2A—2A of FIG. 1.
Figure 2B:
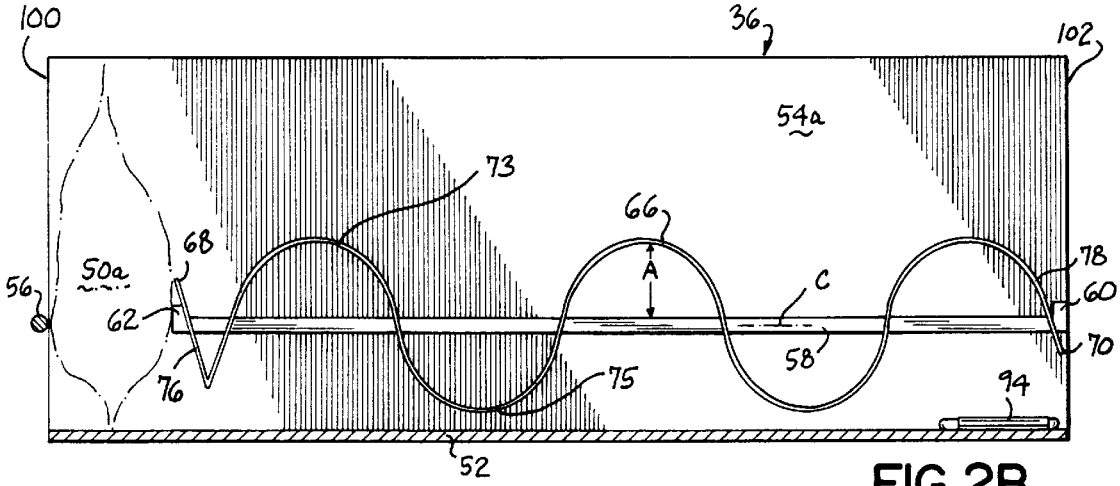
FIG. 2B is view similar to FIG. 2A illustrating the configuration of the serpentine-shaped pusher when all but one product is removed from the track of FIG. 2A.
Figure 2C:
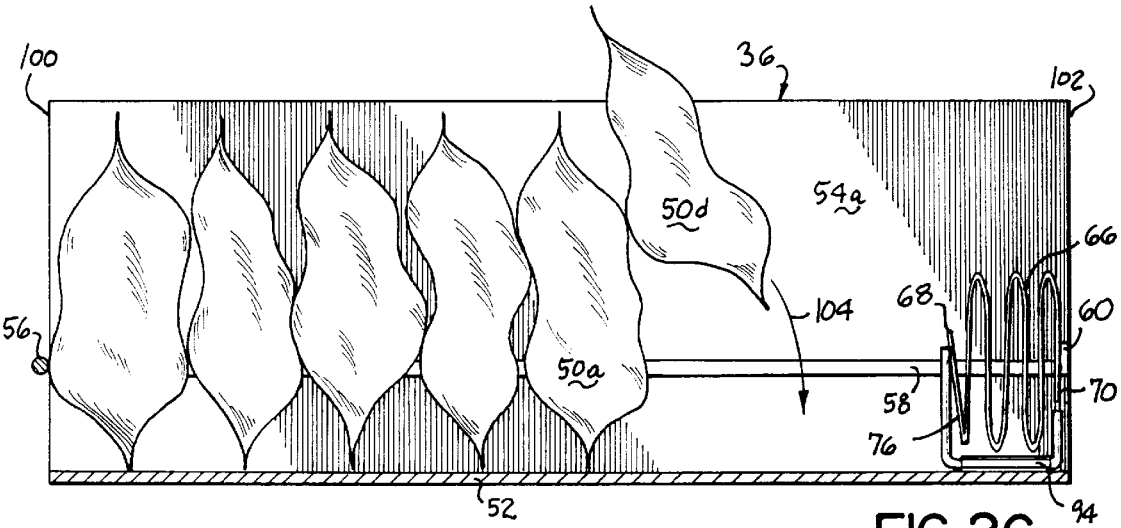
FIG. 2C is a view similar to FIG. 2A but with the pusher pulled back and held in a fully compressed position to enable additional product to be added to the track.

As illustrated in FIGS. 2A–2C, each product holder 36 is adapted to hold a plurality of products 50 therein including a rearmost product 50*a* and a forwardmost product 50*b*. As the forwardmost product 50*b* is removed by a consumer from a track, the second forwardmost product 50*c* moves forwardly along with the other products 50 inside the track due to forwardly directed pressure being exerted on the remaining products by a serpentine shaped pusher 66 so that the second forwardmost product 50*c* becomes the forwardmost product. This process repeats itself each time a product is removed until the rearmost product 50*a* is the only product left in the track (see FIG. 2B).

Figure 4:
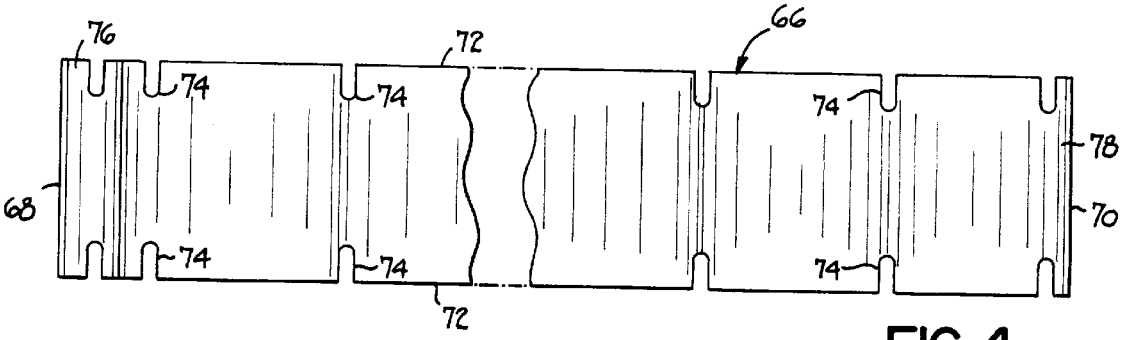
FIG. 4 is a top plan view of the serpentine-shaped pusher of the present invention.

As best illustrated in FIG. 1, the serpentine shaped pusher 66 is located within each product holder 36 or track for urging a column of product forwardly toward the front edge 100 of the product holder 36. The pusher 66 comprises a sheet of inherently flexible resilient plastic material having a sinusoidal configuration. Referring to FIG. 4, the pusher 66 has a front edge 68, a rear edge 70, and two opposed side edges 72. The pusher 66 further may have a plurality of generally rectangular recesses 74 extending inwardly from the side edges 72 of the pusher 66. The recesses 74 are adapted to receive guide rails 58 so that the pusher 66 may lengthen upon the removal of at least one product within a column of products without the pusher 66 separating from the guide rails 58. The pusher 66 has a generally serpentine or sinusoidal shape other than a substantially planar front portion 76 and a rear portion 78. When viewed in cross section (see FIG. 2B), the pusher 66 has a sinusoidal shape. The pusher 66 has upper apexes 73 located above a central axis C and lower apexes 75 located below the central axis C. The amplitude A of the sine wave formed by the pusher 66 is defined as the vertical distance between the central axis C and the upper and lower apexes 73, 75. The guide rails 58 are illustrated as being at the location of the central axis C but need not be for the pusher to work. The amplitude A will increase when the pusher 66 is compressed as illustrated in FIGS. 2A and 2C and will decrease when the pusher 66 is extended (see FIG. 2B). When the recesses 74 of the pusher 66 are engaged with the guide rails 58, the pusher 66 is partially above and partially below the guide rails 58.

The pusher 66 may be made of numerous sheet materials such as sheet plastic or other sheet material. One type of plastic sheet material which has been used successfully is made from an amorphous glycol modified polyethylene terephthalate (PETG), commercially available from Eastman Chemical Company. PETG is a polyester prepared by the reaction of cyclohexanedimethanol and ethylene glycol with terephthalic acid. Polyethylene terephthalate film is generally characterized by a relatively high resistance to failure on repeated flexing, and has high tensile strength and low moisture absorption. Products made of polyethylene terephthalate have high impact strength, the requisite plastic memory and are able to withstand multiple flexions. By plastic memory what is meant is simply the tendency of the material to return to a given shape upon the release of an externally applied force. Though PETG has been successfully used to make a pusher 66, this application does not intend to limit the composition of the pusher to one specific material such as PETG. The pusher 66 may be made of any number of different materials including plastics having acceptable flexion and memory properties, including but not limited to polyesters of which polyethylene terephthalate is one.

The upwardly turned ends 60, 62 of the guide rails 58 prevent the pusher 66 from extending beyond the front ends 62 of the guide rails 58 so that when all the products 30 are removed from a track or product holder 36, the pusher 66 will not extend forwardly past the forward ends 62 of the guide rails 58. The rear ends 60 of the guide rails 58 act as stops and provide an anchoring point from which the pusher 66 pushes forwardly.

Figure 3:
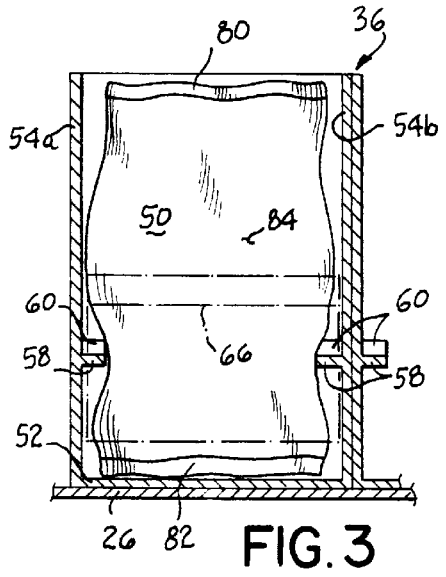
FIG. 3 is a cross-sectional view taken along the lines 3—3 of FIG. 1.

As illustrated in FIG. 3, each product 50 may have a top seam 80 and a bottom seam 82 which are generally more rigid than the middle portion 84 of the product (chip bag). As illustrated in FIG. 3, the guide rails 58 compress the chip bag in the middle portion 84 of the chip bag but generally do not interfere with the ability of the product or chip bag to slide forwardly inside the track because the top and bottom seams are relatively rigid.

Figure 3A:
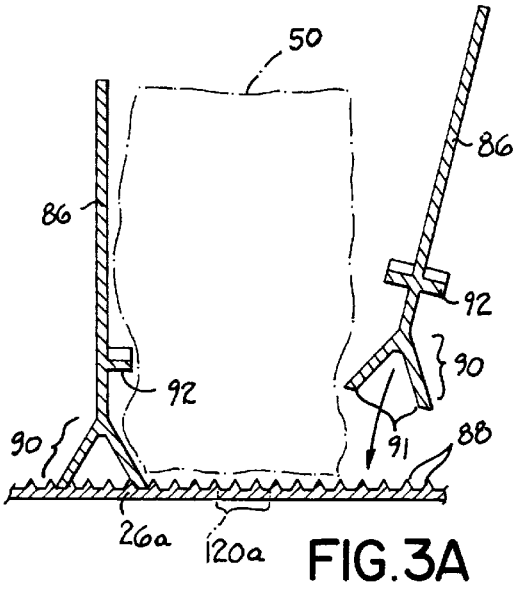
FIG. 3A is a view like FIG. 3 of an alternative embodiment of the present invention.

An alternative embodiment of the present invention is illustrated in FIG. 3A. In this embodiment, product 50 is located between movable dividers 86. The dividers 86 may be independently movable with respect to the shelf bottom member 26*a* or fixedly secured to the bottom member 26*a* of the shelf. A pair of dividers 86 and the bottom member 26*a* of the shelf define a track for supporting a plurality of products arranged in a column between the pair of dividers. This bottom member 26*a* of the shelf may have a plurality of upwardly extending ribs 88 rather than a flat planar bottom member. The dividers 86 may have an inverted V-shaped bottom portion 90 having two diverging legs 91 adapted to abut against the ribs 88 of the bottom member 26*a* of the shelf. Again, the dividers 86 extend from front to back on the shelf but are not part of a U-shaped product holder 36 as in the first embodiment of the present invention.

Further, the dividers 86 have guide rails 92 either integrally formed with the dividers or attached to the dividers. The guide rails 92 are otherwise identical to the guide rails 58 of the product holders 36. The movable dividers 86 may be identical to those disclosed in U.S. Pat. No. 5,577,623 which is herein incorporated by reference. Similarly, the dividers may be secured to the shelf and held in place by any other methods or mechanisms such as that disclosed in U.S. Pat. No. 5,450,968 which is herein incorporated by reference.

Referring now to FIGS. 2A–2C, FIG. 2A illustrates a product holder 36 containing six products 50 including a rearmost product 50*a*, a forwardmost product 50*b* and a second forwardmost product 50*c*. As described hereinabove, as the forwardmost product 50*b* is removed, the serpentine shaped pusher 66 pushes on the rearwardmost product 50*a* which pushes on the other products, all the products being pushed forwardly. This process repeats itself until the rearwardmost product 50*a* is the only product left in the product holder 36 and the serpentine shaped pusher 66 abuts against the upwardly turned ends 62 of the guide rails 58 inside the product holder 36. Once the forwardmost product 50*a* is removed, the product holder 36 may be lifted away from the shelf and reloaded with product.

Figure 6:
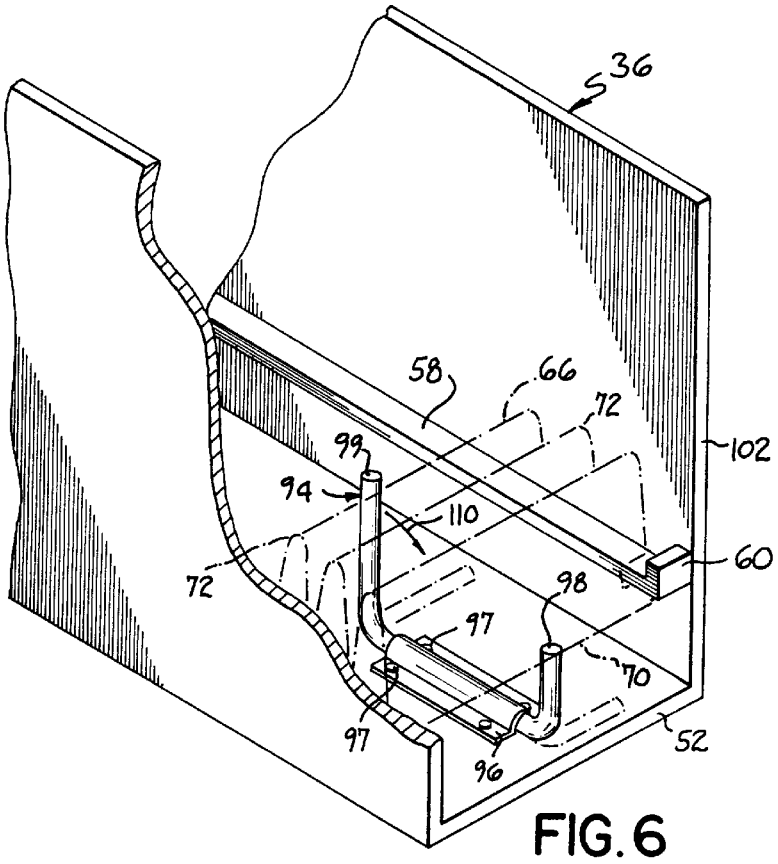
FIG. 6 is a perspective view of a product holder of the present invention, the product holder having a locking mechanism mounted therein.

As illustrated in FIGS. 2C and 6, a generally U-shaped locking mechanism 94 may be secured to the bottom 52 of the product holder 36 or the bottom member of a shelf within a track. The locking mechanism 94 is secured to the bottom of the product holder 36 with a bracket 96 riveted or otherwise fastened to the bottom with fasteners 97. The U-shaped locking mechanism 94 has a short leg 98 and a long leg 99. When the loader of the product holder desires to put more product in the product holder, he or she compresses the pusher 66 rearwardly against the rear ends of the guide rails increasing the amplitude of the pusher. The loader then moves the locking mechanism 94 upwardly 90° to the position illustrated in FIG. 6 such that the pusher 66 is located generally behind the long leg 99 of the locking mechanism 94. In this position, the pusher 66 is held rearwardly without the loader having to use one hand to hold back the pusher while loading product with the other hand. The loader may use both hands to place additional product 50*d* inside the product holder 36 in the direction of arrow 104 (see FIG. 2C). Once the product holder is sufficiently full, the loader may rotate the locking mechanism 94 approximately 90° in the direction of arrow 110 to the position illustrated in dashed lines in FIG. 6. In this down position, the U-shaped locking mechanism 94 is flat against the bottom 52 of the product holder 36. With the locking mechanism in this down position, the serpentine shaped pusher 66 may extend forwardly until it abuts against the rearwardmost product located within the product holder. Once loaded, the product holder may be placed on the shelf and the next product holder may be loaded in a similar manner.

Figure 7:
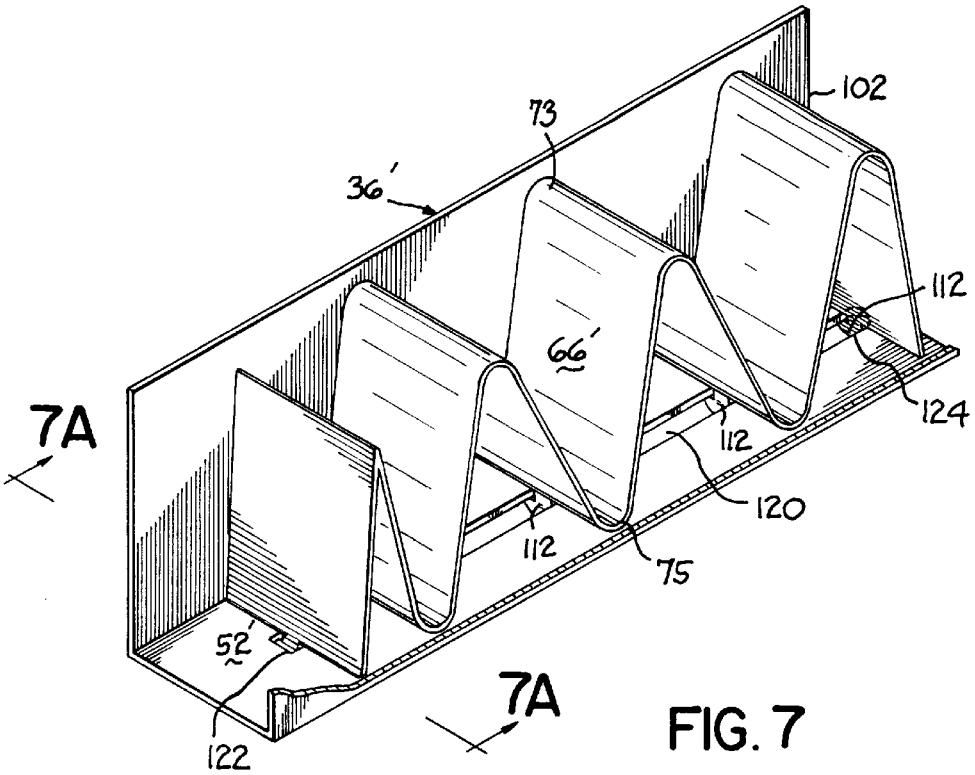
FIG. 7 is a perspective view of a product holder of the present invention having a slot therethrough and a serpentine-shaped pusher having tabs adapted to engage the slot.
Figure 7A:
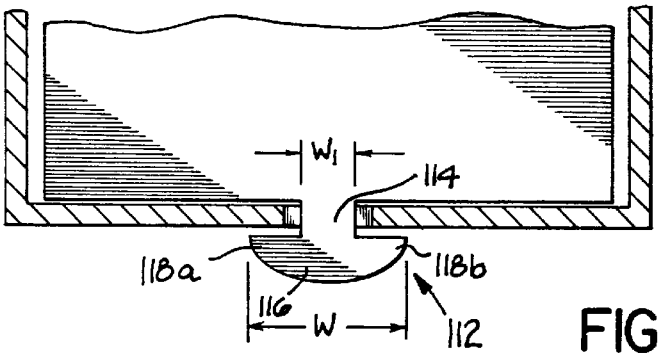
FIG. 7A is a view taken along the lines 7A—7A of FIG. 7.

Referring to FIG. 7, the serpentine-shaped pusher of the present invention may have a plurality of tabs 112 extending downwardly from the lower apexes 75 of the pusher, one tab per lower apex. The tabs 112 may be integrally formed with the remainder of the serpentine-shaped pusher 66' or, alternatively, may be separately manufactured and secured to the pusher via any known method such as gluing or welding. As seen in FIG. 7A, each tab 112 has a generally vertical throat portion 114 and lower portion 116. The lower portion 116 has two side portions 118*a* and 118*b* such that the width W of the lower portion 116 is larger than the width $W_1$ of the throat portion 114. Although one specific configuration of tab is illustrated, other configurations of tabs may be used as well.

The product holder 36' has a longitudinally extending slot 120 therethrough formed in the bottom 52' of the product holder 36'. The slot 120 has a front end 122 and a back end 124. The back end 124 of the slot 120 is approximately located at the rear edge 102 of the product holder but, alternatively, may be located at other locations along the bottom of the product holder. The tabs 112 of the serpentine-shaped pusher 66' are adapted to engage the slot 120 so as to enable the serpentine-shaped pusher 66' to push product forwardly within the product holder 36' without the tabs 112 disengaging from the slot 120. The pusher 66' may be removed from the product holder 36' by twisting on the tabs 112 causing the tabs 112 to disengage from the slot 120 and pulling the pusher upwardly away from the product holder 36'. In this way, pushers can be easily moved from product holder to product holder and removed for cleaning and other purposes.

Additionally, bottom member 26 of shelf 24 may have a slot (not shown) therein between each set of dividers so as to enable a serpentine-shaped pusher having tabs to be used. FIG. 3A illustrates one such slot 120*a* in bottom member 26*a* (shown in dashed lines).

Figure 8:
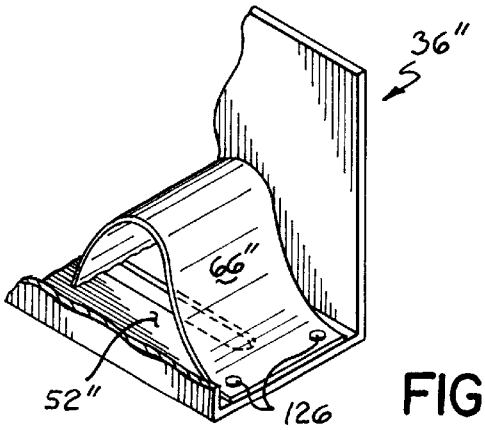
FIG. 8 is a perspective view of a product holder having a slot therethrough and a serpentine shaped pusher riveted at the rear thereof to the bottom of the product holder.

Referring to FIG. 8, the rear of the pusher 66" may alternatively be riveted or otherwise secured to the bottom 52" of the product holder 36" with rivets 126 or other fasteners. In this embodiment, a tab 112 need not extend downwardly from the rear of the pusher as in the embodiment illustrated in FIG. 7. In this embodiment, the rivets 126 function as the stop against which the pusher pushes forwardly. If the embodiment of the shelf shown in FIG. 3A is utilized, the pusher 66" may be riveted downwardly to the bottom member of the shelf 24 between any pair of dividers. Regardless of whether the pusher has downwardly extending tabs adapted to engage a slot or whether the pusher has multiple recesses adapted to receive guide rails, the rear of a pusher may be riveted or otherwise secured to the bottom of either a product holder or the bottom member of a shelf.

Thus, the serpentine shaped pusher of the present invention provides a device for urging products forwardly in tracks on a shelf without the use of any springs or any multiple piece device. Instead, the serpentine shaped pusher comprises simply a relatively low cost sheet of material having a memory characteristic tending to urge the pusher forwardly into a sinusoidal orientation. Thus, the pusher of the present invention is less expensive to manufacture and easier to install and use than heretofore known pushers. Additionally, it has been found to be particularly useful in urging fragile, breakable products, such as bags of potato chips, to the front of a shelf a product holder without breaking or damaging those fragile products.

Although I have described several detailed embodiments of the present invention, it will be readily appreciated by those of ordinary skill in the art that many modifications may be made without departing from the spirit and scope of the present invention. It is therefore applicant's intention to be bound only by the scope of the following claims and not by the detailed specifics provided in the specification above.

I claim:

1. A shelf assembly comprising:

a shelf having a bottom;

a pair of substantially parallel spaced dividers extending from back to front, said pair of dividers and said bottom defining a track for supporting a plurality of products arranged in a column between said pair of dividers; and a serpentine shaped pusher having recesses adapted to engage guide rails secured to said pair of dividers for urging said column of products forwardly along said track.

2. The shelf assembly of claim 1 wherein said dividers are solid members.

3. A shelf assembly comprising:

a shelf having a bottom;

a plurality of substantially parallel spaced dividers extending from back to front, a pair of said dividers and said bottom defining a track for supporting a plurality of products arranged in a column between said pair of dividers;

guide rails secured to said dividers; and a serpentine shaped pusher for urging said column of products forwardly along said track, said pusher comprising a sheet of inherently resilient flexible plastic material having a memory characteristic which urges said pusher to a particular sinusoidal configuration, said pusher being adapted to extend between a stop and a rearwardmost product in a column of products in said track so as to urge said column of products forwardly, wherein said pusher has a plurality of recesses extending inwardly from side edges of said pusher, said guide rails extending into said recesses.

4. The shelf assembly of claim 3 wherein said pusher may lengthen upon the removal of at least one product within said column without said pusher separating from said guide rails.

5. The shelf assembly of claim 3 wherein said guide rails are spaced above said bottom of said shelf.

6. The shelf assembly of claim 3 wherein said guide rails have enlarged ends.

7. The shelf assembly of claim 3 wherein said pusher extends partially above said guide rails and partially below said guide rails.

8. The shelf assembly of claim 3 wherein said pusher is made of plastic.

9. A shelf assembly comprising:

a shelf having a bottom member;

a plurality of substantially parallel spaced dividers extending upwardly from said bottom member and extending from back to front, a pair of said dividers and said bottom member defining a track for supporting a plurality of products arranged in a column between said pair of dividers;

guide rails secured to said dividers; and a generally sinusoidal shaped pusher for urging said column of products forwardly along said track, said pusher comprising a sheet of material having a memory characteristic which returns said pusher to a relatively low amplitude configuration from a relatively high amplitude configuration, said pusher being adapted to extend between a stop and a rearwardmost product in a column of products in said track so as to urge said column of products forwardly in said track, said pusher having a plurality of recesses adapted to slidably engage said guide rails.

10. The shelf assembly of claim 9 wherein said pusher is made of polyethylene terephthalate.

11. The shelf assembly of claim 9 wherein said pusher is made of plastic.

12. A shelf assembly comprising:

a shelf support;

a shelf;

a plurality of substantially parallel product holders supported by said shelf, each product holder comprising a bottom and a pair of dividers extending upwardly from said bottom, said dividers having guide rails secured thereto, said product holder being adapted to support a plurality of products arranged in a column between said pair of dividers; and a pusher within at least one of said product holders for urging product forwardly, said pusher having multiple recesses and comprising a sheet of inherently resilient material having a sinusoidal configuration, said pusher being compressible between a rearwardmost product in said column and a stop so as to push said column of products forwardly, said recesses of said pusher being adapted to receive said guide rails.

13. The shelf assembly of claim 12 wherein said product holder has a bumper at the front thereof.

14. The shelf assembly of claim 12 wherein said guide rails are spaced above said bottom of said product holder.

15. The shelf assembly of claim 12 wherein said guide rails are engaged with said recesses such that said pusher may partially flatten upon the removal of a forwardmost product within said column without said pusher separating from said dividers.

16. The shelf assembly of claim 12 wherein said guide rails have upwardly turned ends.

17. The shelf assembly of claim 12 wherein said pusher is made of polyethylene terephthalate.

18. The shelf assembly of claim 12 wherein said pusher is made of plastic.

19. The shelf assembly of claim 12 wherein said bottom of said product holder has a slot therethrough adapted to receive tabs extending outwardly from said pusher.

20. A shelf assembly comprising:

a shelf cantilevered from a shelf support;

a plurality of substantially parallel generally U-shaped product holders supported by said shelf, each product holder comprising a bottom and a pair of dividers extending upwardly from said bottom, said product holder being adapted to support a plurality of products arranged in a column between said pair of dividers and having guide rails secured to the pair of dividers; and a plurality of serpentine shaped pushers within selected product holders for urging product forwardly within said product holders, each pusher comprising a sheet of inherently resilient material having a sinusoidal configuration and having recesses being adapted to engage said guide rails.

21. The shelf assembly of claim 20 wherein said guide rails are spaced above the bottom of said product holder.

22. The shelf assembly of claim 20 wherein said pusher is plastic.

23. The shelf assembly of claim 20 wherein said guide rails have upwardly turned ends.

24. The shelf assembly of claim 20 wherein each product holder has a bumper at the front of the product holder.

25. The shelf assembly of claim 20 wherein said shelf comprises a bottom member having an upwardly turned lip at the front of said shelf.

26. The shelf assembly of claim 20 wherein said bottom of said product holder has a slot therethrough.

27. The shelf assembly of claim 26 wherein said serpentine shaped pusher has tabs, said tabs being engagable with said slot enabling said serpentine shaped pusher to extend in said product holder without said pusher separating from said bottom of said product holder.

28. The shelf assembly of claim 27 wherein said serpentine shaped pusher may be separated from said product holder by twisting said tabs, disengaging said tabs from said slot.

29. A combination of a serpentine-shaped pusher and a generally U-shaped product holder adapted to support a plurality of products arranged in a column, said product holder comprising a bottom and a pair of sidewall dividers extending upwardly from said bottom, each sidewall divider having a guide rail secured thereto; and said serpentine shaped pusher comprising a sheet of inherently resilient material having a sinusoidal configuration, said pusher having recesses adapted to engage said guide rails such that said pusher may expand without separating from said guide rails.

30. The combination of claim 29 wherein said pusher is compressed between a rearwardmost product in said product holder and a stop so as to push said column of products forwardly.

31. The combination of claim 30 wherein said stop comprises upwardly turned ends of said guide rails.

32. The combination of claim 29 wherein said guide rails have upwardly turned ends.

33. The combination of claim 29 wherein said pusher is plastic.

34. A combination of a serpentine shaped pusher and a generally U-shaped product holder adapted to support a plurality of products arranged in a column, said product holder comprising a bottom and a pair of sidewall dividers extending upwardly from said bottom, said bottom having a slot therethrough; and said serpentine shaped pusher comprising a sheet of inherently resilient material having a sinusoidal configuration, said pusher having tabs adapted to engage said slot such that said pusher may expand without separating from said bottom of said product holder.

35. The combination of claim 34 wherein said tabs extend downwardly from lower apexes of said serpentine shaped pusher.

36. The combination of claim 34 wherein said tabs are independent elements secured to said serpentine shaped pusher.

37. A shelf assembly comprising:

a shelf having a bottom member and a plurality of substantially parallel spaced dividers extending upwardly from said bottom member and extending from back to front, a pair of said dividers and said bottom member defining a track for supporting a plurality of products arranged in a column between said pair of dividers, said bottom member having a slot therethrough; and a pusher having a generally sinusoidal shaped configuration adapted to urge said column of products forwardly along said track, said pusher comprising a sheet of material having a memory characteristic which returns said pusher to a relatively low amplitude sinusoidal configuration from a relatively high amplitude configuration, said pusher being adapted to extend between a stop and a rearwardmost product in a column of products in said track so as to urge said column of products forwardly in said track said pusher having a plurality of tabs adapted to slidably engage said slot.

38. The shelf assembly of claim 37 wherein said tabs are engaged with said slot such that said pusher may partially flatten upon the removal of a forwardmost product within said column without said pusher separating from said track.

39. A shelf assembly comprising:

a shelf having a front frame member and a rear frame member and a plurality of substantially parallel spaced dividers extending between said front frame member and said rear frame member;

a U-shaped product holder supported by a pair of said dividers, said product holder comprising a bottom and a pair of sidewall dividers extending upwardly from said bottom, a pair of guide rails being secured to said sidewall dividers, said product holder being adapted to support a plurality of products arranged in a column between said pair of sidewall dividers; and a serpentine shaped pusher for urging said column of products forwardly inside said product holder, said pusher comprising a sheet of inherently resilient flexible plastic material having a memory characteristic which urges said pusher to a particular sinusoidal configuration, said pusher having recesses adapted to engage said guide rails.

40. The shelf assembly of claim 39 wherein said pusher is adapted to extend between a stop and a rearwardmost product in said column of products in said product holder so as to urge said column of products forwardly.

41. The shelf assembly of claim 39 wherein said dividers have a horizontal portion and a vertical portion.

42. A combination of a serpentine-shaped pusher and a track adapted to support a plurality of products arranged in a column, said track comprising a bottom and a pair of dividers extending upwardly from said bottom, each divider having a guide rail secured thereto; and said serpentine shaped pusher comprising a sheet of material having a sinusoidal configuration, said pusher having recesses adapted to engage said guide rails such that said pusher may expand without separating from said guide rails.

43. A combination of a serpentine shaped pusher and a track adapted to support a plurality of products arranged in a column, said track comprising a bottom and a pair of dividers extending upwardly from said bottom, said bottom having a slot therethrough; and said serpentine shaped pusher comprising a sheet of material having a sinusoidal configuration, said pusher having tabs adapted to engage said slot such that said pusher may expand without separating from said bottom of said track.

* * * * *